US005091630A

United States Patent [19]

Djuric

[11] Patent Number: 5,091,630

[45] Date of Patent: Feb. 25, 1992

[54] HAIR CURLING APPARATUS MOUNTED TO A HAIR DRYER OUTLET CONDUIT WITH AN ADAPTER SLEEVE ARRANGEMENT ROTATABLY MOUNTED AND ROTATED BY HEATED AIR FLOW

[76] Inventor: Zoran Djuric, 55 Cosburn Ave. #208 (Ontario), Toronto, Canada, M4K-2E9

[21] Appl. No.: 608,837

[22] Filed: Nov. 5, 1990

[51] Int. Cl.[5] ..... A45D 2/36; A45D 20/50; F24H 1/06

[52] U.S. Cl. ..... 219/222; 34/97; 34/101; 132/112; 132/118; 132/212; 132/229; 132/271; 392/380; 392/385

[58] Field of Search ..... 392/379-385, 392/365-368; 219/222, 225, 226; 34/96-101, 243 R; 132/271, 212, 112-116, 117, 118, 229

[56] References Cited

U.S. PATENT DOCUMENTS

| | | | |
|---|---|---|---|
| 3,491,774 | 1/1970 | Carbone | 392/384 X |
| 3,820,551 | 6/1974 | Lanzillutta | 132/229 |
| 3,890,984 | 6/1975 | Lesetar | 132/271 |
| 4,023,578 | 5/1977 | Buhler | 132/271 |
| 4,430,808 | 2/1984 | Toyomi et al. | 34/101 X |
| 4,520,256 | 5/1985 | Doyle | 219/225 |
| 4,926,027 | 5/1990 | Montagino et al. | 132/271 X |

FOREIGN PATENT DOCUMENTS

| | | | |
|---|---|---|---|
| 2501682 | 7/1976 | Fed. Rep. of Germany | 132/212 |
| 2556808 | 7/1976 | Fed. Rep. of Germany | 132/212 |
| 617332 | 5/1980 | Switzerland | 132/212 |

*Primary Examiner*—Anthony Bartis
*Attorney, Agent, or Firm*—Leon Gilden

[57] ABSTRACT

A hair curling apparatus includes an adapter sleeve mounted to the end of the hot air delivery conduit of a hand-held hair dryer. A hot air delivery tube extends through the adapter sleeve and terminates in an apertured portion projecting forwardly of the sleeve. Rotatably mounted on the projecting portion is a circumferentially apertured and bristled hollow hair curling sleeve for effecting hair curling procedures. The hair curling sleeve includes a plurality of vanes in the interior thereof which react with the directed hot air flow through the apertured portion of the delivery tube to impart rotation to the hair curling sleeve. The adapter sleeve includes a manually operable valve for controlling the air flow through the delivery tube to the curling sleeve.

5 Claims, 4 Drawing Sheets

HAIR CURLING APPARATUS MOUNTED TO A HAIR DRYER OUTLET CONDUIT WITH AN ADAPTER SLEEVE ARRANGEMENT ROTATABLY MOUNTED AND ROTATED BY HEATED AIR FLOW

BACKGROUND OF THE INVENTION

1. Field of the Invention

The field of invention relates to hair curling apparatus, and more particularly pertains to a new and improved hair curling apparatus wherein the same permits selective directing of heated air to a curling sleeve.

2. Description of the Prior Art

Various hair curling apparatus has been set forth in the prior art to direct heat to individual hair in a curling procedure. Such apparatus may be found in U.S. Pat. No. 4,520,256 to Doyle wherein an air inlet is mounted within a coaxially aligned handle of the organization.

U.S. Pat. No. 4,641,010 to Abura, et al. provides a battery powered electric hair curler organization, with a hair curling rod mounted within a hair curling mount or barrel.

U.S. Pat. No. 4,756,320 to Andis utilizes electrical resistance heating element mounted within a hair curling cylinder to direct heat exteriorly of the cylinder to enhance a hair curling procedure.

U.S. Pat. No. 4,411,281 to Doern and U.S. Pat. No. 4,468,554 to Andis are further examples of coaxially aligned hair curling rod-like assemblies.

As such, it may be appreciated that there continues to be a need for a new and improved hair curling apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of hair curling apparatus now present in the prior art, the present invention provides a hair curling apparatus wherein the same provides an organization selectively and readily mounted to an existing hair curling output cylinder. As such, the general purpose of the present invention, which will be described subsequently in greater detail, is to provide a new and improved hair curling apparatus which has all the advantages of the prior art hair curling apparatus and none of the disadvantages.

To attain this, the present invention provides an apparatus for mounting in alignment with a heated hair dryer output conduit, with an adapter sleeve mounted to the output conduit, with the adapter sleeve including a delivery tube directed therethrough. The delivery tube includes a forwardly positioned apertured portion positioned exteriorly of the adapter sleeve body and rotatably mounting a hair curling sleeve thereabout. The hair curling sleeve includes apertures and bristles to effect a hair curling procedure. The adapter sleeve includes a rod directed diametrically therethrough, wherein the rod includes a central bore to selectively direct heated air from the hair dryer output conduit to the hair curling sleeve. The adapter sleeve is rotatably mounted about the rod to include vanes mounted within the adapter sleeve to receive directed hot air to impart rotation to the adapter sleeve.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair curling apparatus which has all the advantages of the prior art hair curling apparatus and none of the disadvantages.

It is another object of the present invention to provide a new and improved hair curling apparatus which may be easily and efficiently manufactured and marketed.

It is a further object of the present invention to provide a new and improved hair curling apparatus which is of a durable and reliable construction.

An even further object of the present invention is to provide a new and improved hair curling apparatus which is susceptible of a low cost of manufacture with regard to both materials and labor, and which accordingly is then susceptible of low prices of sale to the consuming public, thereby making such hair curling apparatus economically available to the buying public.

Still yet another object of the present invention is to provide a new and improved hair curling apparatus which provides in the apparatuses and methods of the prior art some of the advantages thereof, while simultaneously overcoming some of the disadvantages normally associated therewith.

Still another object of the present invention is to provide a new and improved hair curling apparatus wherein the same is readily mounted to an existing heated air output conduit of a hair drying device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
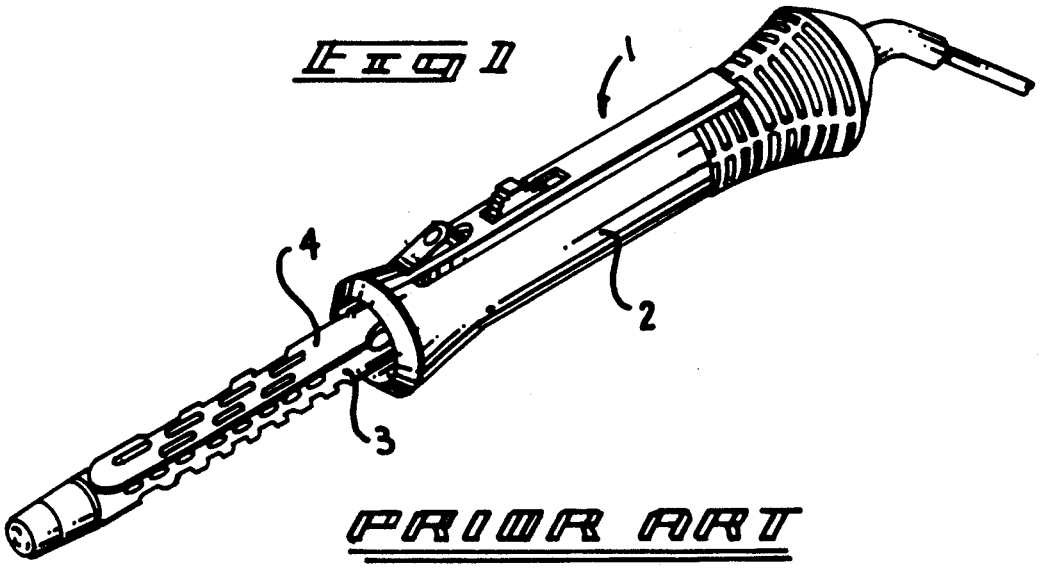
FIG. 1 is an isometric illustration of a prior art hair curling apparatus.
Figure 2:
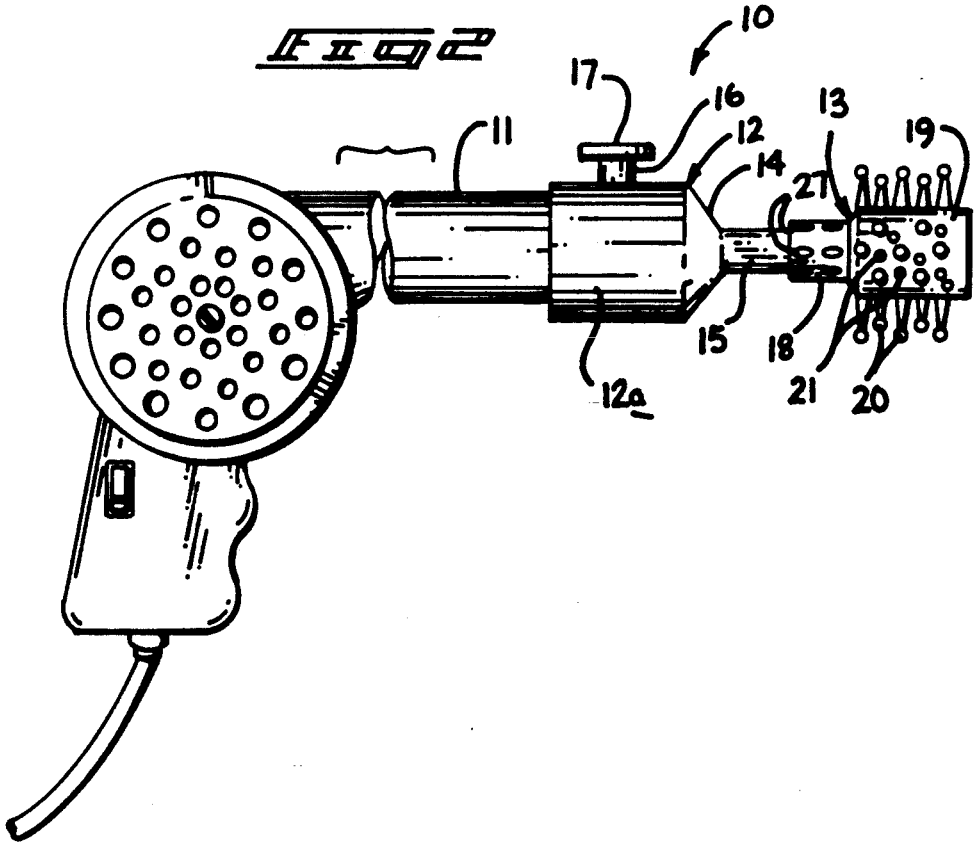
PRIOR ART Fig 2
FIG. 2 is an orthographic side view, taken in elevation, of the instant invention.
Figure 3:
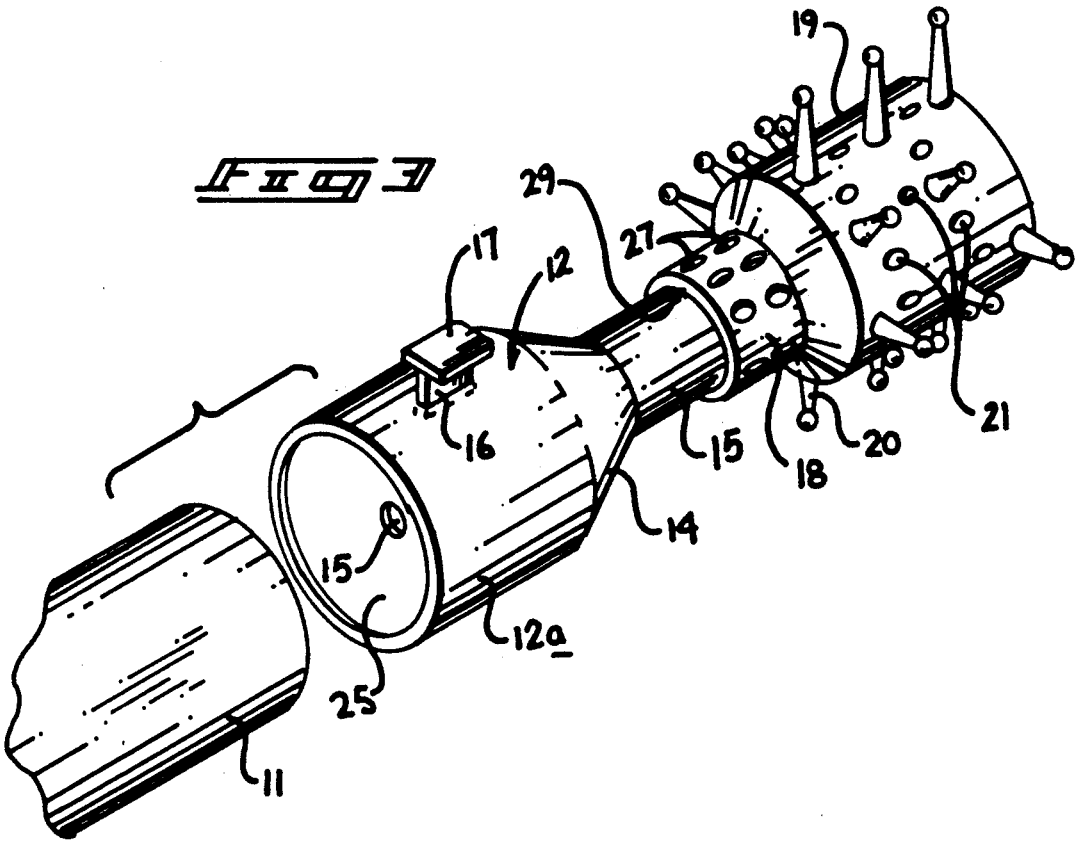
FIG. 3 is an isometric illustration of the instant invention in a disassembled orientation relative to an existing hair dryer output conduit.

With reference now to the drawings, and in particular to FIGS. 1 to 7 thereof, a new and improved hair curling apparatus embodying the principles and concepts of the present invention and generally designated by the reference numeral 10 will be described.

FIG. 1 illustrates a prior art hair curling apparatus 1, including a central body 2, including heated air directed therethrough into a curling iron body 3, with an overlying clip 4, in a manner as set forth in U.S. Pat. No. 4,520,256.

More specifically, the hair curling apparatus 10 of the instant invention is in combination with a hair dryer output conduit 11, of a pistol grip type hair dryer, as illustrated, or of an elongate coaxial type. The apparatus includes an adapter sleeve 12 whose rear end portion defines a predetermined internal diameter substantially equal to a predetermined first diameter defined by the hair dryer output conduit. The adapter sleeve 12 includes an adapter sleeve main body 12*a*, with a conical forward end and a delivery tube 15 directed through the main body 12 and through the conical forward end, 14 thereof (see FIG. 4) and extending forwardly thereof to an apertured delivery tube extension 28, as illustrated in FIG. 5 for example. The adapter sleeve includes a valve rod 16 diametrically directed through the main body 12*a*. with an enlarged head member 17 projecting above the main body 12*a* and fixedly mounted to an upper terminal end of the valve rod 16. Rotatably mounted about the delivery tube extension 28 is a hair curling sleeve 13. The hair curling sleeve 13 includes a mounting tube 18 coaxially aligned and extending rearwardly of the main portion of the hair curling sleeve 13, and includes a matrix of second apertures 27 in conjunction with the first apertures 21 directed through the curling sleeve 13 main body. Further, a matrix of resilient bristles 20 are diametrically extending outwardly of the main body of the curling sleeve to enhance engagement with hair portions in a curling procedure. The main body 19 of the curling sleeve 13 is defined by a main body diameter greater than that of the mounting tube 18.

Figure 4:
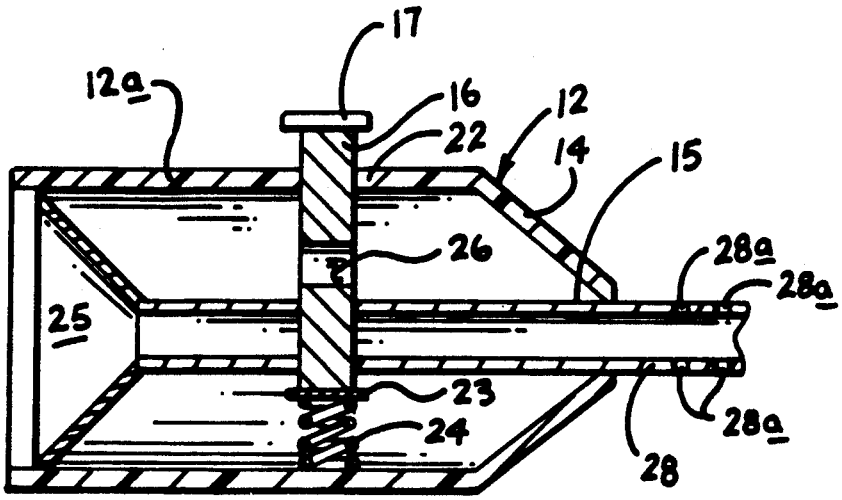
FIG. 4 is an orthographic cross-sectional illustration of the adapter sleeve utilized by the instant invention along a section line longitudinally directed through the adapter sleeve of FIG. 3, for example, medially directed through elements 16 and 17.
Figure 5:
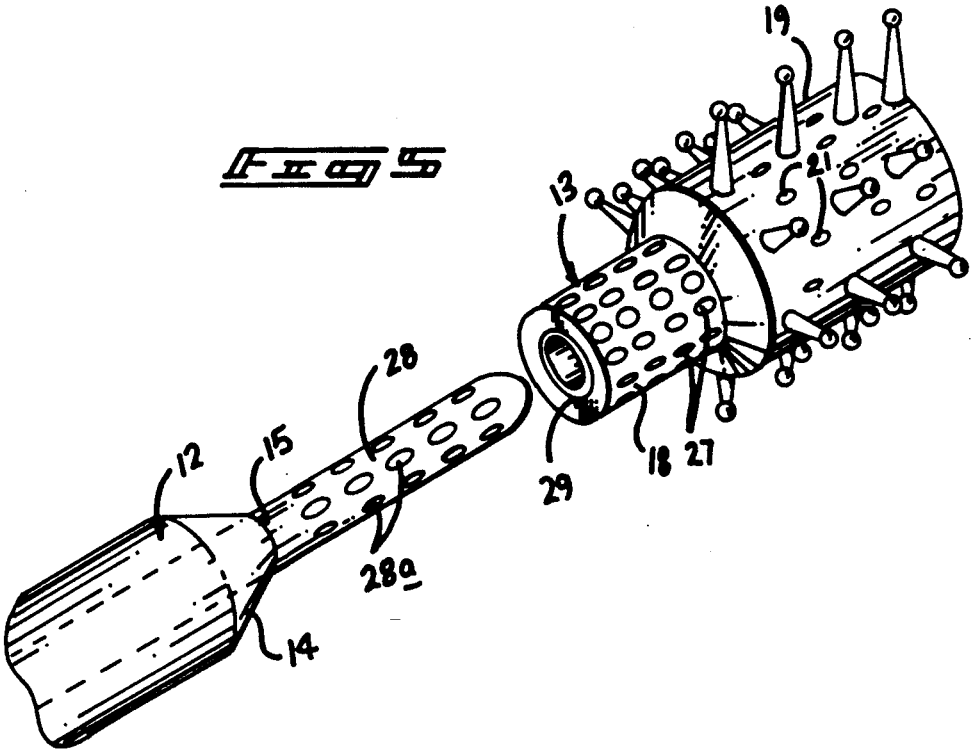
FIG. 5 is an isometric illustration of the adapter sleeve in a separated relationship relative to the hair curling sleeve.
Figure 6:
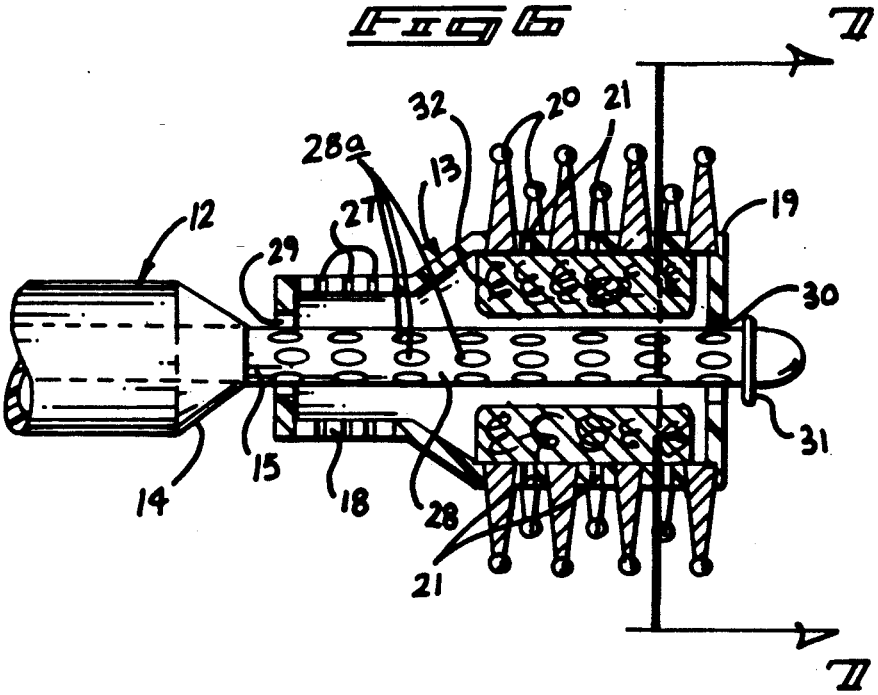
FIG. 6 is an orthographic cross-sectional illustration of the hair curling sleeve mounted to the delivery tube of the adapter sleeve taken along the lines 6—6 of FIG. 7 in the direction indicated by the arrows.
Figure 7:
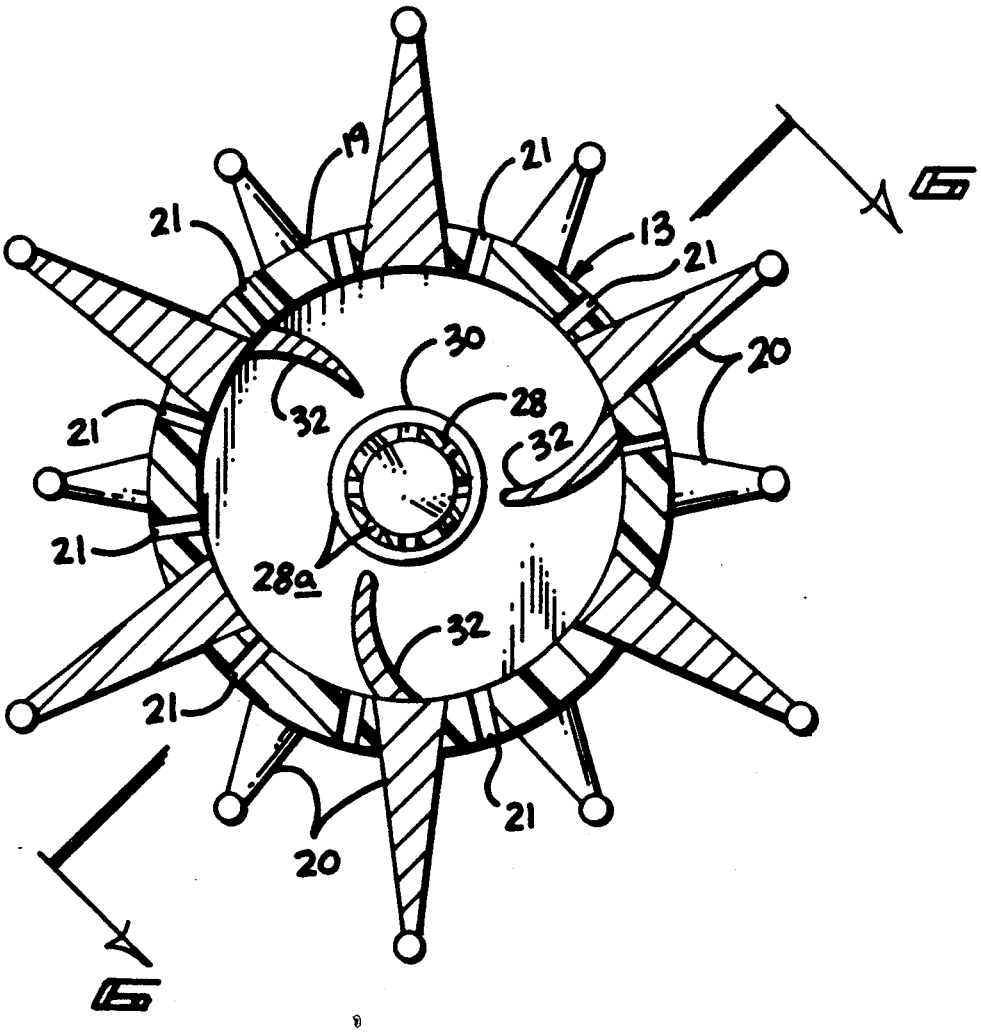
FIG. 7 is an orthographic cross-sectional illustration of the hair curling sleeve of the instant invention taken along the lines 7—7 of FIG. 6 in the direction indicated by the arrows.

With reference to FIG. 4, the valve rod 16 is mounted within a friction sleeve 22 directed through the wall of the adapter sleeve main body 12*a* to frictionally orient the valve rod 16 when positioned. A rod bore 26 is directed through the rod 16 arranged parallel to the delivery tube 15 for alignment with the delivery tube 15 to permit a force flow of heated air from the hair dryer output conduit 11 received through an input funnel 25 whose conical configuration is coaxially aligned with the delivery tube 15 to direct the heated air therethrough. A spring member 24 is captured between a support plate 23 integrally mounted to a lower terminal end of the rod 16 to assist in biasing the rod 16 in a raised orientation.

As illustrated, the apertured delivery tube extension 28 is mounted within and coextensively through the hair curling sleeve 13 whose apertures direct the heated air interiorly of the curling sleeve body and is rotatably mounted within a rear and forward bearing 29 and 30 respectively formed in the rear and forward terminal ends of the sleeve 13. A resilient "O" ring 31 functions as a lock ring and is mounted overlying and in surrounding relationship to the delivery tube extension 28 adjacent its forward end to position and maintain the sleeve 13 about the delivery tube extension 28. Arcuate vanes 32 project interiorly from the interior wall of the apertured cylindrical curling head 19 and thereby enhance rotation of the curling sleeve during use in directing hair thereabout in a curling and setting operation.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair curling apparatus comprising, in combination, a hot air dryer having a longitudinally aligned hair dryer output conduit, and an adapter sleeve mounted to a forward terminal end of the output conduit and in air flow communication therewith, and the adapter sleeve including an open ended delivery tube extending therethrough directing heated air from the air output conduit through the adapter sleeve, and the delivery tube including a longitudinally aligned delivery tube extension extending beyond the end of the adapter sleeve, the delivery tube extension mounting a hair curling sleeve for rotation thereabout, extending through the hair curling sleeve and including rotation means for rotatably mounting the hair curling sleeve, the hair curling sleeve including a main body, with a matrix of resilient bristles projecting exteriorly thereof, the bristles radially aligned relative to the hair curling sleeve, and the delivery tube extension including a plurality of apertures oriented interiorly of the curling sleeve to direct the heated air into the curling sleeve, and a plurality of arcuate vanes mounted interiorly of the hair curling sleeve and projecting interiorly of the hair curling sleeve in communication with the apertures of the delivery tube extension to enhance rotation of the hair curling sleeve about the delivery tube extension, wherein the adapter sleeve includes an input funnel overlying the hair dryer output conduit, the input funnel being in communication with the inlet end of the delivery tube, and a valve rod diametrically directed through the adapter sleeve and delivery tube, the valve rod including a head member arranged for manual grasping of the valve rod, the head member projecting exteriorly of the adapter sleeve, and the valve rod including a bore directed therethrough, the bore arranged parallel to the delivery tube, and the valve rod positionable from a raised position with said bore spaced above the deliver tube to a lowered position, with the bore aligned with the delivery tube.

2. An apparatus as set forth in claim 1 wherein the valve rod includes a support plate fixedly mounted to a lower terminal end of the valve rod below the delivery tube, and a spring member captured between the support plate and an interior wall of the adapter sleeve to normally position the valve rod in a raised position.

3. An apparatus as set forth in claim 2 wherein the delivery tube extension projecting forwardly of the hair curling sleeve includes a lock ring mounted about the delivery tube extension exteriorly of the hair curling sleeve to maintain the hair curling sleeve about the delivery tube extension.

4. An apparatus as set forth in claim 3 wherein the hair curling sleeve includes a matrix of curling sleeve apertures directed therethrough in communication with the tube extension apertures for receiving heated air from the apertured delivery tube extension through the hair curling sleeve apertures.

5. An apparatus as set forth in claim 4 wherein the rotation means is mounted within the main body and includes a rear bearing and a forward bearing rotatably receiving the delivery tube extension within the hair curling sleeve about the delivery tube extension.

* * * * *